US005463824A

United States Patent [19]

Barna

[11] Patent Number: 5,463,824

[45] Date of Patent: Nov. 7, 1995

[54] ARCH SUPPORT SYSTEM AND METHOD FOR MANUFACTURE AND USE

[76] Inventor: Randall S. Barna, 61548 W. Ridge Ave., Bend, Oreg. 97702

[21] Appl. No.: 78,744

[22] Filed: Jun. 16, 1993

[51] Int. Cl.[6] ..... A43B 13/38; A43B 13/41

[52] U.S. Cl. ..... 36/44; 36/43; 36/173

[58] Field of Search ..... 36/44, 43, 71, 36/140, 143, 144, 145, 166, 173, 174, 175, 178, 181

[56] References Cited

U.S. PATENT DOCUMENTS

| | | | |
|---|---|---|---|
| 628,699 | 7/1899 | Damrell | 36/44 |
| 999,524 | 8/1911 | Swarzschild | 36/173 |
| 1,144,291 | 6/1915 | Boyer . | |
| 1,704,187 | 3/1929 | Glidden et al. | 36/44 |
| 1,867,431 | 7/1932 | Wood | 36/145 |
| 1,978,549 | 10/1934 | Muir | 36/44 |
| 2,078,502 | 4/1937 | Marron . | |
| 2,599,589 | 6/1952 | Silverman et al. . | |
| 2,644,250 | 7/1953 | Ciaio | 36/44 |
| 2,726,413 | 12/1955 | Williams . | |
| 2,911,973 | 11/1959 | Chieffo . | |
| 3,265,071 | 8/1966 | Kirchner et al. . | |
| 4,170,233 | 10/1979 | Bunsick . | |
| 4,346,525 | 8/1982 | Larsen et al. . | |
| 4,387,516 | 6/1983 | Laux . | |
| 4,439,934 | 4/1984 | Brown | 36/173 |
| 4,651,445 | 3/1987 | Hannibal | 36/140 |
| 4,688,338 | 8/1987 | Brown | 36/172 |
| 4,729,179 | 3/1988 | Quist, Jr. | 36/44 |
| 4,747,410 | 5/1988 | Cohen . | |
| 4,759,357 | 7/1988 | Allart et al. . | |
| 4,774,954 | 10/1988 | Ibrahim | 36/140 |
| 4,910,886 | 3/1990 | Sullivan et al. . | |
| 4,926,569 | 5/1990 | Bunch . | |
| 4,991,317 | 2/1991 | Lakic . | |
| 5,146,698 | 9/1992 | Tilles et al. . | |

FOREIGN PATENT DOCUMENTS

| | | | |
|---|---|---|---|
| 257878 | 2/1925 | United Kingdom | 36/44 |

*Primary Examiner*—Steven N. Meyers

*Attorney, Agent, or Firm*—Klarquist, Sparkman, Campbell, Leigh & Whinston

[57] ABSTRACT

An arch support having an upper surface portion, a formed elastomeric lower cushion portion, and a stretch-resisting mat of interwoven nonelastic fibers integrally attached between the upper surface and lower cushion portions to resist lateral and longitudinal stretching during use. The stretch-resisting member may take a variety of shapes to conform to the needs of various foot arch shapes. The arch support has a preselected configuration with dimensions that fall within preselected ranges to complement and provide appropriate support for selected foot arch categories. The arch support may be fitted to an individual user using a system which has a plurality of arch supports of preselected configurations to complement the shape and positioning of the arches of a variety of users' feet and an open top cradle for simulating the fit of the inside of a shoe on which the arch support is rested to have the user try it for fit.

9 Claims, 3 Drawing Sheets

ARCH SUPPORT SYSTEM AND METHOD FOR MANUFACTURE AND USE

BACKGROUND AND SUMMARY OF THE INVENTION

This invention relates to an arch system for a user's foot and a method for its manufacture and use, and more particularly to such which provides defined support for a variety of users' arch configurations.

Many individuals encounter some sort of foot-related problem. Often these might be alleviated by proper arch support. However, in the past, arch supports have been either prohibitively expensive, or have failed to provide the needed level and positioning of support.

A basic object of the present invention is to provide a novel pre-formed arch support specifically designed to correctly position the user's foot during weight-bearing use to minimize stress and reduce excessive angular and torsional forces on the foot and joints to which it is connected.

Bio-mechanical orthotics must provide elevated support beneath an individual's foot in order to function properly. They also must interact with the contours, forces and mechanics of the foot as it dynamically functions in a shoe.

A user's body is very sensitive to placement of support under the foot; therefore, the support must fall within close tolerance ranges. If a given area of the orthotic has too much support, it will be uncomfortable and rejected by the user. If it has too little support, it will have minimal function for eliminating the problem for which it was prescribed. An area that is both functional and tolerable in an orthotic will be defined herein as the Tolerance/Function Zone (T/F Zone).

Further, the materials from which the orthotic is manufactured play a role in its design and affect the acceptability of the product. This is also true of the manner in which the orthotic is made or fitted to the individual user's foot.

In the past, it was commonly believed that the most successful approach to providing orthotics that fell within the proper T/F Zone was to custom-fabricate them specifically to a user's feet. However, it has been found that for the vast majority of needs, an arch support system and method for fitting according to the present invention offers a mass-produced orthotic that falls within appropriate T/F Zones.

Some problems that have existed with prior orthotics include the use of materials that are either too rigid or lack sufficient resilience. Materials that are too rigid often will not be tolerated by the user, will damage shoes in which they are used, lack proper shock absorption, and do not provide proper shear or torsional absorption. Materials that are too flexible have a tendency to break down, resulting in loss of function, will over-compress, lack durability, and lack proper shock absorption.

Problems with prior designs and methods can be found in both custom-made and pre-made devices. For custom-made devices, there has been a lack of consensus on fabrication, methods and materials, inconsistency of application of molding techniques due to use of different technicians, long delays in order time, and high cost to the user. Prior pre-made devices generally have provided an inaccurate fit with a high likelihood of intolerance or of function and have provided little or no method for accurately fitting the correct model to the user.

A general object of the present invention is to provide a novel arch support which overcomes such problems with previously known devices, and can be manufactured in an economic and efficient manner.

Another object is to provide such a novel arch support which has a cushioning foot support portion, and an integral stretch-resisting member incorporated integrally therein which serves to stabilize the cushioning portion to provide needed support throughout operation.

Yet another object of the present invention is to provide a system for fitting an elongate arch support to a user by providing a plurality of arch supports of preselected configuration to complement the shape and positioning of the arches of a variety of users' feet and also providing an open-top cradle for simulating the fit of the inside of a shoe upon which individual arch supports may be placed, and the user's foot placed thereon to determine proper tolerance of fit.

A still further object of the present invention is to provide a novel arch support which has specific dimensional configurations to provide appropriate support for a user's foot when associated with and used in a shoe.

Yet another object is to provide a novel method for manufacturing an arch support in an efficient and cost-effective manner.

These and other objects and advantages will become more fully apparent as the following description is read in conjunction with the drawings wherein.

DETAILED DESCRIPTION OF PREFERRED EMBODIMENT OF THE INVENTION

Figure 1:
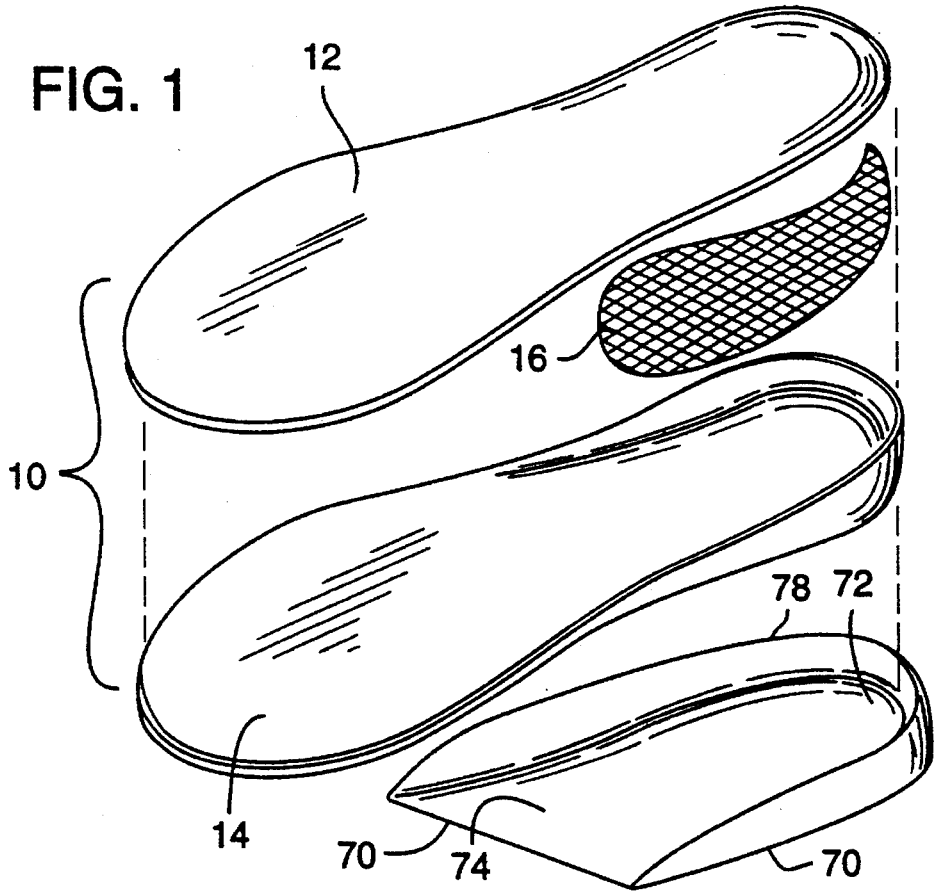
FIG. 1 is an exploded perspective view of an arch support according to the present invention and a sizing cradle used with such arch support.

Referring first to FIG. 1, a 10 is indicated generally on elongate arch support for use in a shoe. It comprises a top cover, or upper surface portion, 12, a formed elastomeric lower cushion portion 14, and a planer stretch-resisting member 16. These three elements are adhered together into an integral unit as depicted in FIGS. 2–6. The top cover and lower cushion portion have the general outline of the interior of the shoe, to fit within a shoe.

In the illustrated embodiment, the top cover, or upper surface portion, 12, is composed of a substantially consistent thickness sheet of polyurethane foam. This may be approximately 1/16 inch thick and may be of a material known in the industry as Poron, which has been widely accepted and proven in the shoe-insole industry. The open-cell structure of this material allows it to breathe and dissipate moisture and may be treated with anti-bacterial and anti-odor agents. The durometer of the material used is approximately Shore A22. The natural fat-padded areas of the human foot range is Shore A20–25 to provide a comparative number. This type cover functions to provide a comfort surface between the foot and the firmer lower cushion portion.

The lower cushion portion 14 is comprised of a shock-absorbing, flexible elastomeric material, such as that known in the industry as Viscolas. Such material has the capability to absorb shear, torsion and shock, yet be extremely flexible and highly supportive, even under heavy weights.

The polyurethane elastomeric material is chosen over previously used foam materials due to its non-cellular structure and its capability to deform in a fluid motion by stretching and deforming away from pressure. Previously used cellular foams simply compress upon deformation and will reach a limit of compression and eventually break down, lose their resiliency, and fail to absorb adequate levels of shock, because when they are deformed, they merely spring back with approximately equal force. The elastomer used in the present invention, on the other hand, returns to its original shape more slowly than the speed with which it was deformed, thus absorbing shock.

The elastomer used also has advantages over rigid orthotics, in that the arch of a rigid orthotic contacts the shoe at either end, analogous to the span of a bridge. When pressure is applied to a rigid orthotic, the forces transfer to the points contacting the shoe, which can distort the surface, resulting in loss of support. Further, this can cause premature shoe wear.

The stretch-resisting member 16 comprises a sheet of interwoven strands of carbon fiber material. These are elongate, non-elastic fibers, oriented at substantial angles to one another to form a substantially planer mesh.

Describing briefly the method for producing an arch support according to the present invention, a mold having mating upper and lower mold parts is provided that defines a cavity having the configuration of a desired finished arch support as illustrated in FIGS. 2–6. The overall configuration of the formed arch support will be described in greater detail below. With the mold parts open, a pre-formed top cover, such as that indicated generally at 12, is placed against the inner surface of one mold part, which will define the upper surface of the arch support. A sheet of stretch-resisting material 16 is placed against the heel portion of the top cover facing away form the mold part. A layer of adhesive may be placed between the top cover and stretch-resisting member to maintain them in place in the mold cavity. The mold then is closed, and a fluid visco-elastic material is injected into the remainder of the mold cavity to form the remainder of the arch support. Such material bonds to the inner surface of the top cover and stretch-resisting sheet to form an integral arch support.

The polyurethane material is a combination of two liquid parts that combine and produce a resultant reaction to create a cured elastomer. When cured, it has desired properties of both hardness and elasticity. The desired hardness may range from Shore A30 (±2) for use with cavus feet, to approximately Shore A40 (±2) for planus or neutral feet configurations.

An arch support constructed according to the invention from such method, is illustrated generally in FIGS. 2–9. The arch support has a rear heel region 20, a central arch region 22, and a toe region 24. The heel region terminates at a rear heel extremity 26, also referred to herein as the apex point of the posterior heel radius. The support has a medial side 28 and a lateral side 30. The medial side is that portion which would be positioned toward the inside of a user's foot, and the lateral side is toward the outside, away from the user's opposite foot.

Figure 4:
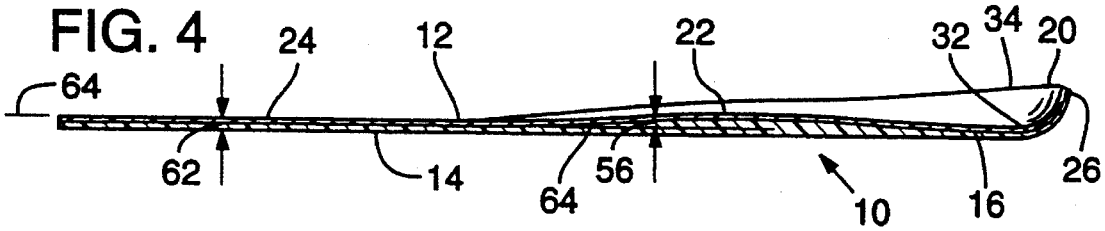
FIG. 4 is a cross-sectional view taken generally along the line 4—4 in FIG. 2.

As is best seen in FIGS. 1 and 4, a depressed heel cup 32 is provided in the heel region of the arch support, with upstanding side margin 34 of remainder portions of the heel region of the support surrounding the heel cup.

Figure 5:
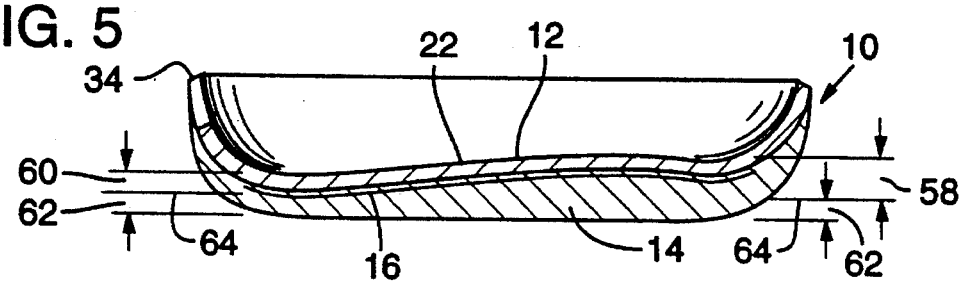
FIG. 5 is an enlarged cross-sectional view taken generally along the line 5—5 in FIG. 3.

Referring to FIG. 4, the upper surface of the arch support curves upwardly from heel cup 32 to arch region 22 and then progressing further toward toe region 24, becomes substantially planer or flat. Referring to FIG. 5, there may be a rise in contour of the upper surface on progressing from the lateral toward the medial side of the support in the arch region. Such contours are to provide appropriate support for the user's foot.

Figure 6:
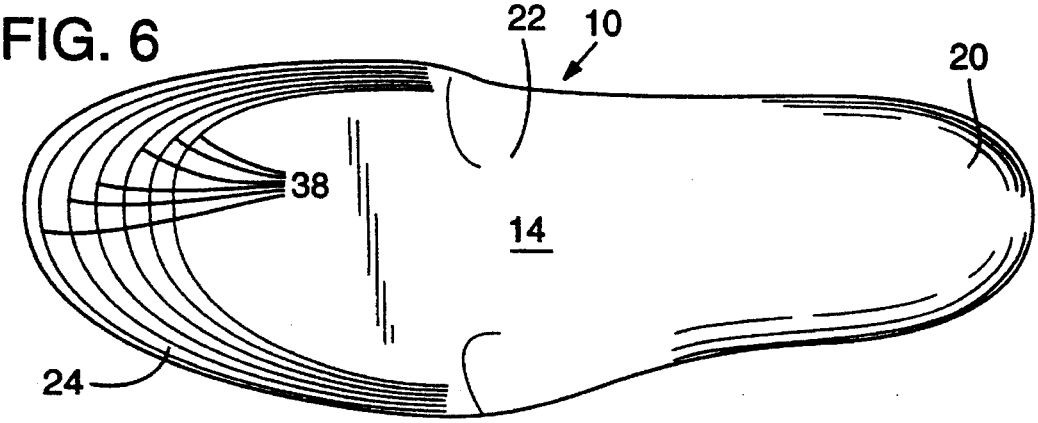
FIG. 6 is a bottom view of the arch support.

Referring to FIG. 6, a plurality of arcuate lines 38 are formed into the bottom surface of the arch support. These arcuate lines indicate different shoe sizes to which the arch support may be trimmed to properly fit in a user's shoe. The materials from which the support is manufactured permit scissor-cutting as desired, particularly in the thinner toe region of the arch support.

Figure 7:
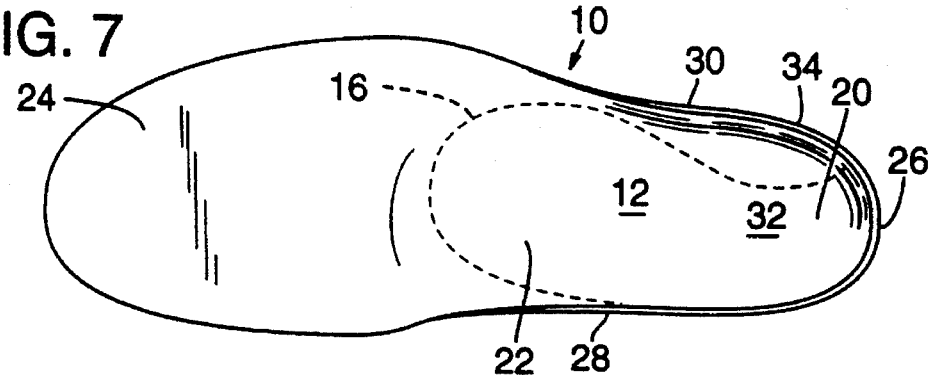
FIGS. 7, 8 and 9 are top plan views of arch supports which would be used with planus, neutral, and cavus feet, respectively.

Referring to FIGS. 1, 7, 8 and 9, it will be seen that stretch-resisting member 16 may take a variety of shapes to provide the desired dynamic stability for the arch support structure for various foot configurations. As is seen in FIGS. 1 and 7, a substantially teardrop-shaped member is illustrated. This configuration and positioning is used in an arch support that would be used primarily for planus (low arch) feet. The member is substantially teardrop-shaped, the larger portion of which is disposed in the arch region of the support, and the smaller portion of which curves into the rear heel region of the support. The member is positioned generally along the medial side of the support. In this instance and in others, the stretch-resisting member is confined to one side of the heel and arch regions of the support and terminates short of the opposite side.

Figure 8:
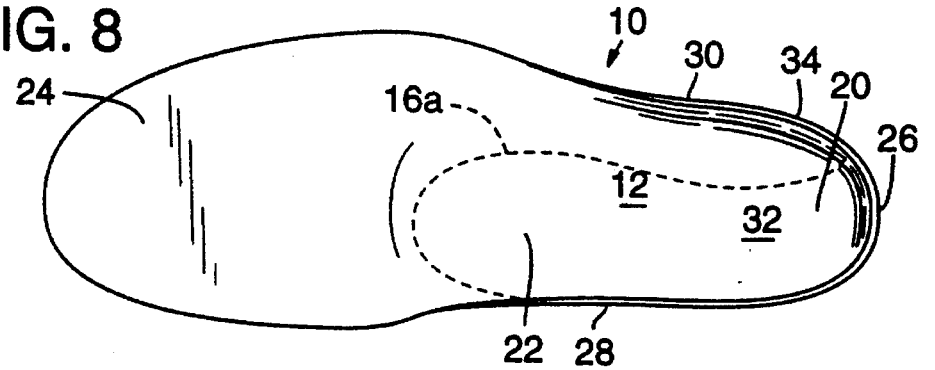

In FIG. 8, a support which may be used for a neutral configuration foot (medium height arch) is illustrated having a stretch-resisting member **16*a*. This member also has a somewhat teardrop-shaped configuration but is narrower than that illustrated at 16 in FIG. 7**, and is positioned along the medial side of the support.

Figure 9:
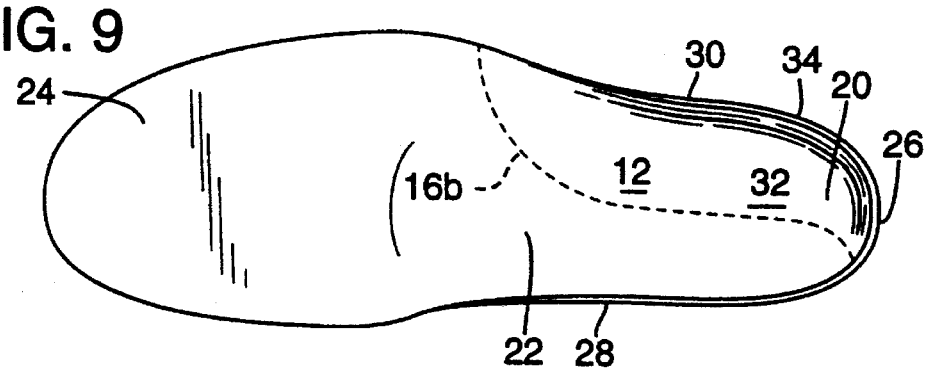

In FIG. 9, a support for a cavus (high arch) foot is illustrated having a stretch-resisting member **16*b*** that has a somewhat S-shaped configuration. This member extends along the lateral side of the arch support, with one end terminating at the lateral side of the arch region of the support, and the other end curving into the heel region of the support.

The stretch-resisting member in each of these arch supports provides what is referred to herein as "dynamic stabilization." When a user's foot impacts against the support, there is tendency for the material of the support to compress and spread away from the region of impact. The stretch-resisting member is integrally incorporated into the arch support to resist longitudinal and lateral stretching of the support in the region of the sheet. This minimizes elongation of the region of the support in the area of the stretch-resisting member to provide improved support throughout operation.

It has been found that a major portion of the population can be accommodated with arch supports of three types or categories (planus, neutral, and cavus) using four specifically contoured supports for each type. The goal is to provide a fit within the T/F Zone for each of these combinations. By providing as few models as possible to produce an efficient and effective fit for the broadest range of the population, it is possible to make production and dispensing of the product simple and efficient.

Figure 11:
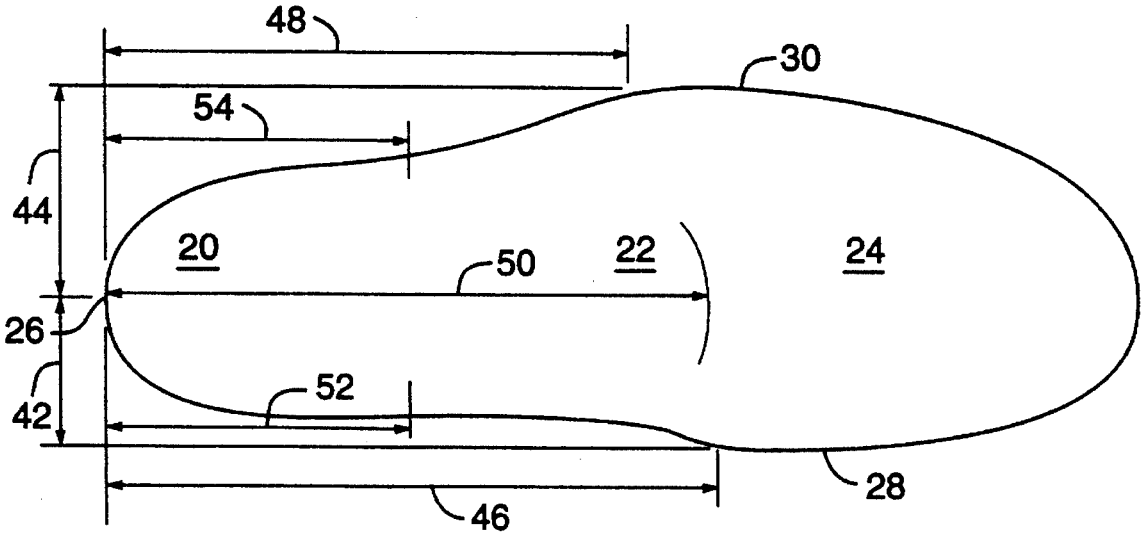
FIG. 11 is a top plan view of an assembled arch support with dimensional lines.
Figure 2:
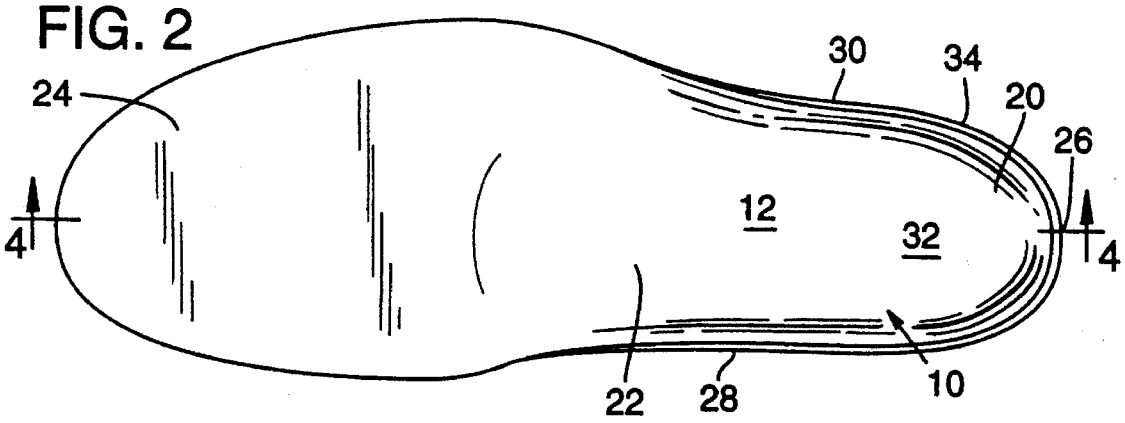
FIG. 2 is a top plan view of an assembled arch support according to the invention.
Figure 3:
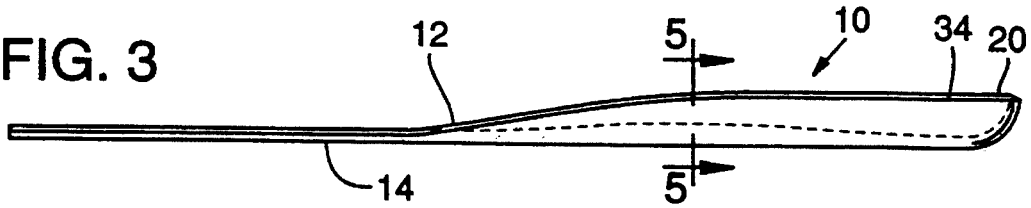
FIG. 3 is a side elevation view of the arch support.

Referring to FIG. 11, a number of points, or dimensions, on an arch support, to be further described herein, are noted. Many are indexed from the apex point 26 of the posterior heel radius. Four arch sizes are identified for each type, these being small, medium, large, and extra large. Each size covers a zone of fit that is equal in size to the other three. This zone is indexed, or measured, on the medial side from the apex of the heel 26 to the apex of the medial protrusion of the first metatarsal head (the ball of the foot). It is measured along a medial arch length line 46 which is spaced a distance 42 of approximately 1.6 inches laterally of apex point 26. On the lateral side, the zone is indexed, or measured, from the apex of the heel 26 to the point at the lateral protrusion of the fifth metatarsal head along a lateral arch length line 48 which is spaced a distance 44, approximately 2.25 inches laterally of the apex of the heel.

Some key measuring elements are the medial arch length 46, the lateral arch length 48, and the transverse arch length 50, the distance to the medial arch apex 52, and the distance to the lateral arch apex 54. Each of these is measured from heel apex point 26. The transverse arch length 50 is the distance from the rear extremity of the heel portion to the forward region of the central section of the arch portion. Medial arch length 46 and lateral arch length 48 indicate the distances from the rear extremity of the heel portion to the forward end of the formed arch on the medial and lateral sides of the support, respectively. The distance to the lateral arch apex 54 and the distance to the medial arch apex 52 are the distances from the rear extremity of the heel portion 26 to the maximum height portion of the arch of the lateral and medial sides of the support, respectively.

The other measurements, or dimensions, of concern are the transverse arch height 56, medial arch height 58, and lateral arch height 60. (See FIGS. 4 and 5). The planer toe, or forward, section 12 of the support has a thickness noted at 62 providing an upper datum plane 64. Transverse arch height 56, medial arch height 58, and lateral arch height 60 are all distances from such datum plane 64 to the top surface of the support at the location specified. Transverse arch height 56 is measured 0.3 to 0.5 inch rearwardly of the forward end of line 50, medial arch height 58 is measured at the forward end of line 52, and lateral arch height is measured at the forward end of line 54.

The following chart illustrates the preferred ranges of dimensions and measurements for the various categories of arch supports relating to cavus, planus, or neutral arch configurations.

| ARCH CATEGORY | | | | | | |
|---|---|---|---|---|---|---|
| | CAVUS | | | | PLANUS | |
| | Small | Medium | Large | X-Large | Small | Medium |
| a. Transverse Arch Length* | 6.6–6.8 | 7.0–7.2 | 7.4–7.6 | 7.8–8.0 | 6.2–6.4 | 6.6–6.8 |
| b. Transverse Arch Height* | .09–1.1 | .09–1.1 | .09–1.1 | .09–1.1 | (–).01–.01 | (–).01–.01 |
| c. Lateral Arch Length* | 5.65–5.95 | 6.05–6.25 | 6.35–6.55 | 6.7–7.0 | 4.25–4.6 | 4.65–4.95 |
| d. Distance to Lateral Arch Apex* | 3.05–3.25 | 3.3–3.4 | 3.5–3.6 | 3.7–3.85 | 3.05–3.25 | 3.3–3.4 |
| e. Lateral Arch Height* | 1.5–.15 | .1–.15 | .1–.15 | .1–.15 | .0–.03 | 0–.03 |
| f. Medial Arch Length* | 6.3–6.6 | 6.7–6.95 | 7.1–7.3 | 7.4–7.75 | 6.7–6.9 | 7.15–7.35 |
| g. Distance to Medial Arch Apex* | 3.05–3.25 | 3.3–3.4 | 3.5–3.6 | 3.7–3.85 | 3.05–3.25 | 3.3–3.4 |
| h. Medial Arch Height* | .65–.75 | .7–.8 | .7–.8 | .75–.85 | .5–.6 | .55–.65 |

| | PLANUS | | NEUTRAL | | | |
|---|---|---|---|---|---|---|
| | Large | X-Large | Small | Medium | Large | X-Large |
| a. Transverse Arch Length* | 7.0–7.2 | 7.4–7.6 | 6.4–6.6 | 6.8–7.0 | 7.2–7.5 | 7.6–7.8 |
| b. Transverse Arch Height* | (–).01–.01 | (–).01–.01 | .04–.06 | .04–.06 | .04–.06 | .04–.06 |
| c. Lateral Arch Length* | 5.0–5.3 | 5.35–5.75 | 5.2–5.5 | 5.6–5.8 | 5.9–6.1 | 6.3–6.6 |
| d. Distance to Lateral Arch* | 3.5–3.6 | 3.7–3.85 | 3.05–3.25 | 3.3–3.4 | 3.5–3.6 | 3.7–3.85 |
| e. Lateral Arch Height* | 0–.03 | 0–.03 | .05–.075 | .05–.075 | .05–.075 | .05–.075 |
| f. Medial Arch Length* | 7.5–7.7 | 7.9–8.15 | 6.5–6.7 | 6.95–7.15 | 7.3–7.5 | 7.7–7.95 |
| g. Distance to Medial Arch Apex* | 3.5–3.6 | 3.7–3.85 | 3.05–3.25 | 3.3–3.4 | 3.5–3.6 | 3.7–3.85 |
| h. Medial Arch Height* | .55–.65 | .6–.65 | .575–.675 | .625–.725 | .625–.725 | .675–.775 |

It has been found that with the dimensions noted herein, a high percentage of the population can be correctly fitted with an arch support that provides the proper T/F Zone.

Defining the measurement points and providing an arch support of proper configuration for use with a shoe is the first portion of providing user comfort. For best results, the correct model and size must be chosen. To complicate this decision, the arch support, or orthotic, eventually will be placed into a shoe. When the arch support of the present invention is placed into the shoe, its flexibility allows it to coordinate with the insole configuration of the shoe to create proper arch support fit for comfort of the user.

To assist in fitting the arch support for a user, a system is provided that includes an open-topped cradle, such as that indicated at 70 in FIG. 1. The cradle is composed of a somewhat resilient material configured to simulate the fit of the inside of a shoe. It includes a heel cup section 72 and an arch section 74. These have generally upper support surface configurations similar to the insole of a shoe. The cradle has a flat bottom, allowing it to rest solidly upon a flat support surface. The forward portion of the cradle has a leading edge portion 76 that tapers to a minimal, or knife-edge, thickness. The heel cup section 72 of the cradle has outer edge portions 78 which extend upwardly to receive and cradle the heel portion of an arch support and thereby inhibit lateral movement of an arch support. When an arch support is positioned atop and resting in the cradle as illustrated in FIG. 10, the arch section 74 of the cradle underlies and supports the arch region 22 of the arch support.

A system for fitting an arch support for a user would include a cradle, as indicated generally at 70 of a size generally to simulate the inside of a shoe that the user would wear, and a plurality of arch supports of preselected configurations as previously described, which may complement the shape and positioning of the arch of the user.

Figure 10:
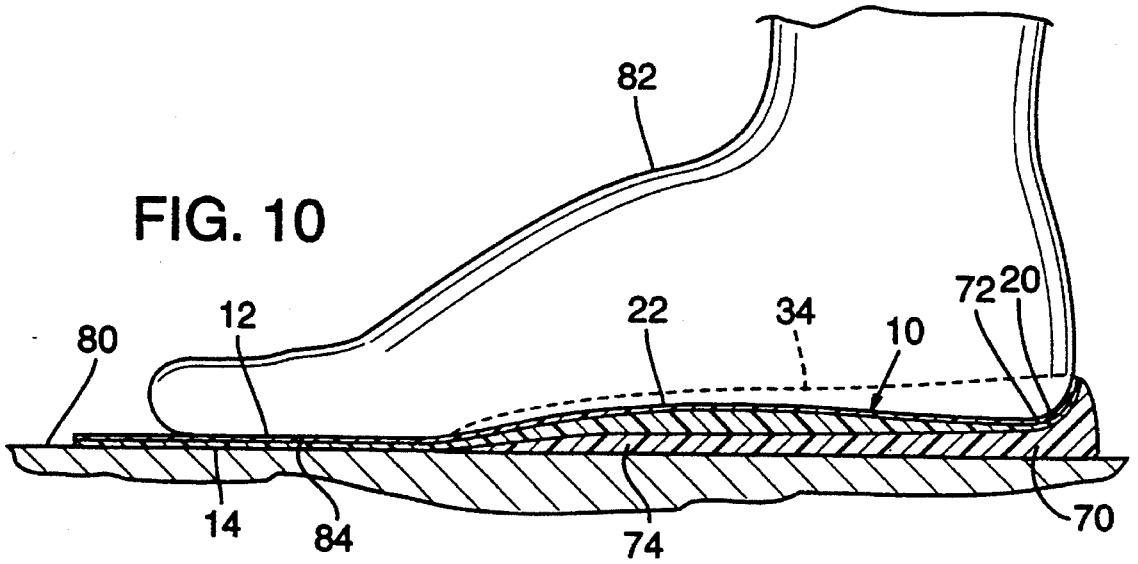
FIG. 10 is a side elevation cross-sectional view of the arch support and cradle being used to fit an appropriate arch support to a user's foot.

Referring to FIG. 10, the cradle is placed on a flat support surface 80, and a selected arch support 10 is placed atop the cradle. The heel region 20 of the arch support fits in heel cup section 72 of the cradle. The arch region 22 of the arch support rests atop arch section 74 of the cradle. The forward toe region of the arch support 24 is supported on surface 80. A user places his foot 82 on the arch support to determine proper fit. The user is able to try the full range of supports to obtain the best fit.

The party fitting the arch support to the user initially would determine whether the user has a planus, neutral, or cavus arch configuration foot. Knowing this, the user would have to try only four different arch supports to determine which provides a complementary and comfortable fit in the T/F Zone.

Thus, those distributing arch supports need to stock only twelve sizes of arch supports and a minimal number of fitting cradles to provide appropriate fit for a high percentage of the known population.

While a preferred embodiment of the invention has been described herein, it should be apparent to those skilled in the art that variations and modifications are without departing from the spirit of the invention.

I claim:

1. A system for fitting an arch support to a user's foot comprising:

a plurality of arch supports, each arch support having one of three specific configuration types with defined upper surface contours to provide substantially continuous support, respectively, for a planus arch, neutral arch, or cavus arch, each said configuration type being provided in a plurality of sizes to accommodate a variety of potential users, each arch support having a heel portion and an arch portion forwardly of the heel portion, with an arch support for a planus arch having an arch portion of a first height, an arch support for a neutral arch having an arch portion of a second height greater than said first height, and an arch support for a cavus arch having an arch portion of a third height greater than said second height, and each said arch support including an upper surface portion, a formed elastomeric lower cushion portion, and a stretch-resisting member integrally attached intermediate said upper surface and lower cushion portions to resist lateral and longitudinal stretching of said support in the region of said stretch-resisting member.

2. An elongate arch support having a rear heel region, a central arch region, a toe region and medial and lateral sides, said support comprising an upper surface portion, a formed elastomeric lower cushion portion, and a stretch-resisting member integrally attached intermediate said upper surface and lower cushion portions to resist lateral and longitudinal stretching of said support in the region of said stretch-resisting member, said stretch-resisting member comprising a sheet of elongate non-elastic fibers oriented at angles to each other confined to said heel and arch regions positioned along the medial side of said support and terminating short of the lateral side of said support, said sheet having a tear-drop shape, the larger portion of which is disposed in the central arch region of the support and the smaller portion of which curves into the rear heel region of the support.

3. The support of claim 2, wherein said sheet is comprised of a mesh of interwoven strands of carbon fiber material.

4. The support of claim 2, wherein said upper surface portion comprises a pad having a smooth upper surface.

5. The support of claim 4, wherein said cushion portion comprises an elastomeric element formed to a selected configuration to provide desired foot support and is adhered to the underside of said pad, and said stretch-resisting member is secured between said pad and elastomeric element.

6. An elongate arch support having a rear heel region, a central arch region, a toe region and medial and lateral sides, said support comprising an upper surface portion, a formed elastomeric lower cushion portion, and a stretch-resisting member integrally attached intermediate said upper surface and lower cushion portions to resist lateral and longitudinal stretching of said support in the region of said stretch-resisting member, said stretch-resisting member comprising a sheet of elongate non-elastic fibers oriented at angles to each other confined to said heel and arch regions positioned along the lateral side of said support and terminating short of the medial side of said support, said sheet having an elongate S-shaped configuration, the central portion of which extends along the lateral side of the support, one end of which terminates at the lateral side of the arch region of the support and the other end of which curves into the heel region of the support.

7. The support of claim 6, wherein said sheet is comprised of a mesh of interwoven strands of carbon fiber material.

8. The support of claim 6, wherein said upper surface portion comprises a pad having a smooth upper surface.

9. The support of claim 8, wherein said cushion portion comprises an elastomeric element formed to a selected configuration to provide desired foot support and is adhered to the underside of said pad, and said stretch-resisting member is secured between said pad and elastomeric element.

* * * * *